US011300110B2

(12) United States Patent
Todman

(10) Patent No.: US 11,300,110 B2
(45) Date of Patent: Apr. 12, 2022

(54) DOUBLE ACTING TWO STAGE INTEGRATED PUMP

(71) Applicant: WABCO Europe BVBA, Brussels (BE)

(72) Inventor: Peter Todman, Upper Poppleton York (GB)

(73) Assignee: ZF CV SYSTEMS EUROPE BV, Brussels (BE)

( * ) Notice: Subject to any disclaimer, the term of this patent is extended or adjusted under 35 U.S.C. 154(b) by 58 days.

(21) Appl. No.: 16/770,625

(22) PCT Filed: Dec. 11, 2017

(86) PCT No.: PCT/EP2017/082242

§ 371 (c)(1),
(2) Date: Jun. 8, 2020

(87) PCT Pub. No.: WO2019/114923

PCT Pub. Date: Jun. 20, 2019

(65) Prior Publication Data

US 2020/0309103 A1 Oct. 1, 2020

(51) Int. Cl.

| | |
|---|---|
| ***F04B 3/00*** | (2006.01) |
| ***F04B 9/04*** | (2006.01) |
| ***F04B 27/02*** | (2006.01) |
| ***F04B 37/14*** | (2006.01) |
| ***F04B 53/14*** | (2006.01) |

(52) U.S. Cl.

CPC ..... *F04B 3/003* (2013.01); *F04B 9/045* (2013.01); *F04B 27/02* (2013.01); *F04B 37/14* (2013.01); *F04B 53/14* (2013.01)

(58) Field of Classification Search

USPC ..... 417/258

See application file for complete search history.

(56) References Cited

U.S. PATENT DOCUMENTS

| | | | | |
|---|---|---|---|---|
| 1,272,651 | A | 7/1918 | Foster | |
| 1,620,870 | A * | 3/1927 | Carrey | F04B 27/02 417/258 |
| 2015/0078932 | A1 | 3/2015 | Ruiz Martinez | |
| 2017/0350249 | A1 | 12/2017 | Rafalski | |
| 2019/0010937 | A1 | 1/2019 | Bredbeck | |

FOREIGN PATENT DOCUMENTS

| | | |
|---|---|---|
| WO | WO 2017137141 A1 | 8/2017 |
| WO | WO 2017137144 A1 | 8/2017 |

* cited by examiner

*Primary Examiner* — Peter J Bertheaud
*Assistant Examiner* — Geoffrey S Lee
(74) *Attorney, Agent, or Firm* — Leydig, Voit & Mayer, Ltd.

(57) ABSTRACT

A piston type pump includes a pump housing having at least one pump inlet, at least one pump outlet, and a piston arrangement connected to a drive shaft configured to, when driven, set the piston arrangement into movement. The piston arrangement includes a first primary stage piston, the first primary stage piston being slidably seated in a first primary stage cylinder formed in the pump housing, and a first secondary stage piston. The first secondary stage piston is slidably seated in a first secondary stage cylinder formed in the first primary stage piston.

17 Claims, 6 Drawing Sheets

DOUBLE ACTING TWO STAGE INTEGRATED PUMP

CROSS-REFERENCE TO PRIOR APPLICATIONS

This application is a U.S. National Phase application under 35 U.S.C. § 371 of International Application No. PCT/EP2017/082242, filed on Dec. 11, 2017. The International Application was published in English on Jun. 20, 2019 as WO 2019/114923 A1 under PCT Article 21(2).

FIELD

The invention relates to a pump, in particular a vacuum pump, comprising a pump housing having at least one pump inlet and one pump outlet and a piston arrangement connected to a drive shaft which, when driven, sets the piston arrangement into movement, wherein the piston arrangement comprises a first primary stage piston, the first primary stage piston being slidably seated in a first primary stage cylinder which is formed in the pump housing, and a first secondary stage piston. Such pumps may be used to induce a vacuum at the pump inlet and/or to provide pressurized fluid at the pump outlet.

BACKGROUND

Vacuum pumps are known, for example, from WO 2017/137144 A1 or WO 2017/137141 A1. Such vacuum pumps are generally referred as piston type vacuum pumps in distinction from so-called rotary vane vacuum pumps. Pumps of the aforementioned types include at least one piston which reciprocatingly moves inside a cylinder. The pump inlet usually is connected with the working chamber formed by the cylinder such that when the piston moves inside the cylinder for increasing the working volume of the working chamber the vacuum is induced at the inlet. For even increasing this vacuum, such piston type vacuum pumps often comprise primary and secondary stages, wherein the secondary stage further increases the vacuum generated by the primary stage.

Pumps of this type are used in passenger vehicles or trucks as in particular vacuum pumps to supply specific modules of the vehicle with a vacuum. This vacuum, for example, is used for brake boost modules, or for pneumatic braking systems in trucks. For common gasoline or diesel engine vehicles the vacuum pump was typically mounted in the engine region and connected to the crank shaft of the engine to be driven. Modern vehicles, however, comprise improved electric systems such that also vacuum pumps of modern vehicles are more often driven used in electric motor.

Problems associated with piston type pumps in the field of vehicles are in particular noise and vibration generation. This in particular is true for single piston one stage piston type pumps. Two stage piston pumps are more balanced from a torque perspective, since the two stages can be driven alternatingly. However, such common two stage piston pumps often suffer a higher out of balance inertia loading which again translates to higher noise and vibration levels.

One piston type vacuum pump, which is balanced in an improved manner, is disclosed in US 2015/0078932 A1. However, this vacuum pump is rather complicated and involves multiple different parts. Moreover, the vacuum pump disclosed in US 2015/0078932 A1 is relatively large compared to common vane type vacuum pumps.

SUMMARY

In an embodiment, the present invention provides a piston type pump. The piston type pump includes a pump housing having at least one pump inlet, at least one pump outlet, and a piston arrangement connected to a drive shaft configured to, when driven, set the piston arrangement into movement. The piston arrangement includes a first primary stage piston, the first primary stage piston being slidably seated in a first primary stage cylinder formed in the pump housing, and a first secondary stage piston. The first secondary stage piston is slidably seated in a first secondary stage cylinder formed in the first primary stage piston.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
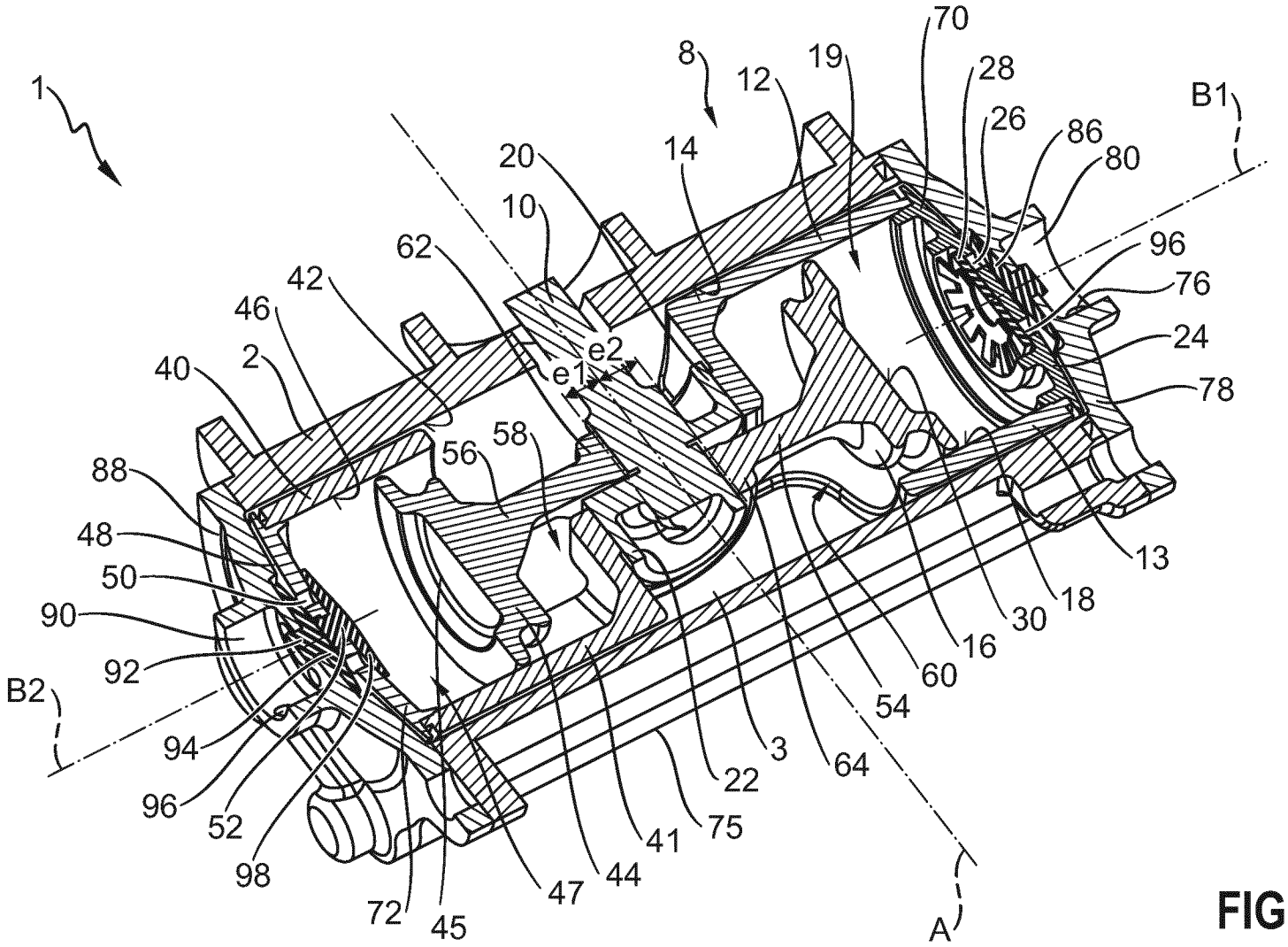
FIG. 1 shows a perspective simplified cut view of the piston type pump.

The present disclosure describes a piston type pump which allows a lower noise and vibration level to be achieved, provides an improved inertia balance, and which, in particular, is also small. The present invention relates, for example, vacuum pumps which are driven by an electric motor inside a vehicle.

The present invention proposes that a first secondary stage piston is slidably seated in a first secondary stage cylinder which is formed in the first primary stage piston. Preferably, the first primary stage piston and the first secondary stage cylinder are integrally formed. For example, the first secondary stage cylinder is machined in the first primary stage piston. They are, thus, preferably formed in a one-piece construction.

Where in the following reference is made to a pump or vacuum pump, it shall also be noted that this pump may also be used as a compressor. Whether it is used as a compressor or a vacuum pump is mainly dependent on how consumers are connected to the pump inlet and/or pump outlet. As a preferred use of the disclosed pump is the vacuum generation, the embodiments are mainly described with respect to the vacuum pump application.

According to the invention, the space within the primary stage piston, which usually has a larger piston face than the first secondary stage piston, is used for forming the first secondary stage cylinder, in which the first secondary stage piston can move in a reciprocating fashion. Due to this arrangement, the overall size of the pump can be reduced. The second stage is formed inside the first stage and not adjacent to it or at any other position. While the first primary stage piston moves relative to the pump housing inside a first primary stage cylinder formed inside the piston housing, the first secondary stage piston moves inside the first primary stage piston. For inducing a vacuum of the second stage it is thus necessary that the first secondary stage piston moves relative to the first primary stage piston and preferably also relative to the pump housing.

This can be achieved in a first preferred embodiment of the pump in that the drive shaft of the pump comprises a first eccentric and a second eccentric, which are phase-shifted by 180°, wherein the first primary stage piston is driven by the first eccentric and the first secondary stage piston is driven by the second eccentric. It shall be understood that also other phase shifts can be preferred, dependent on the overall design of the pump. For example, pumps are known which use a 90 degree phase shift or a 120 degree phase shift. A 180° phase shift however has shown to be efficient and a very well balanced pump can be achieved.

In a preferred further development the first eccentric comprises a first eccentricity with respect to a rotational axis of the drive shaft and the second eccentric comprises a second eccentricity with respect to the rotational axis. The first eccentricity preferably is identical to the second eccentricity. When the first primary stage piston is driven by the first eccentric and the first secondary stage piston is driven be the second eccentric, the stroke of the first primary stage piston and the first secondary stage piston can be identical. However, when a different stroke for the first primary stage piston and the first secondary stage piston is desired, the first and second eccentricities may vary from each other.

Preferably the first and second eccentrics are integrally formed with the drive shaft. Thus, the drive shaft, the first eccentric and the second eccentric are formed in a one-piece construction which makes it possible to reduce parts for the piston type pump.

Moreover, it is preferred that the first primary stage piston comprises a first primary outlet in a first primary piston face and a first primary check valve for the first primary outlet for providing access to the first secondary stage cylinder formed in the first primary stage piston. When the first secondary stage piston is provided within the first secondary stage cylinder formed in the first primary stage piston, an outlet for fluid, in particular air, is necessary which is drawn away from the pump inlet. It has been experienced that it is particularly beneficial to provide this outlet in the first primary piston face, such that the fluid, which has been drawn from the pump inlet by means of the first primary stage piston, may exit the working chamber formed in the first primary stage cylinder through the first primary stage piston. It then enters the first secondary stage working chamber formed within the first secondary stage cylinder.

In the same manner the first secondary stage piston preferably comprises a first secondary outlet in a first secondary piston face and a first secondary check valve for the first secondary outlet for discharging fluid to the pump outlet. As has been described above, the fluid, which is within the first secondary stage cylinder, needs to exit this first secondary stage cylinder through an outlet which, according to this embodiment, is formed in the first secondary piston face. The check valve is necessary to prevent fluid from entering again from the pump outlet to any of the first secondary stage cylinder and the first primary stage cylinder.

According to a further preferred embodiment the piston type pump is formed as a so-called twin piston type pump and therefore comprises a second primary stage piston and a second secondary stage piston, wherein the second primary stage piston is slidably seated in a second primary stage cylinder formed in the pump housing, and the second secondary stage piston is slidably seated in a second secondary stage cylinder formed in the second primary stage piston. Depending on how the different cylinders communicate with each other the second primary stage piston may also form a first tertiary stage piston and the second secondary stage piston may form a first quaternary stage piston. In this manner, the piston type pump, which, according to this embodiment, in total includes four pistons, can form a four-stage piston pump. However, particularly preferred is a two stage twin pump which includes two stages, with four pistons and thus a first and second first stage and a first and second secondary stage.

Preferably, both the first primary stage cylinder and the second primary stage cylinder are connected to the same pump inlet, such that a higher vacuum may be induced at the pump inlet. Alternatively, both the first secondary stage cylinder and the second secondary stage cylinder are connected to the same pump outlet, such that a higher pressure may be provided at the pump outlet.

In case the piston type pump is used as a vacuum pump, the first secondary outlet and a corresponding second secondary outlet may lead to the same pump outlet or to different pump outlets. The fluid, which is discharged from the pump outlet, usually is discharged to the environment, such that no specific consumer or destination is necessary at the pump outlet.

As it has been described with respect to the first primary stage piston and the first secondary stage cylinder, also the second primary stage piston and the second secondary stage cylinder preferably are integrally formed, in particular preferred as a one-piece.

In a further preferred development the first primary stage piston comprises a first central axis and the second primary stage piston comprises a second central axis, which are coaxially arranged. Thus, the first primary stage piston and the first secondary stage piston are on one common axis. This allows a so-called boxer arrangement of the single pistons which may be beneficial for achieving a balance inertia load.

This may even be further improved, when the second primary stage piston is driven by the second eccentric and the second secondary stage piston is driven by the first eccentric. Thus, the first eccentric drives the second secondary stage piston and the first primary stage piston and the second eccentric drives the second primary stage piston and the first secondary stage piston. The intertia acting on the first and second eccentrics thus can be beneficially balanced, which may decrease noise generation and vibration generation.

In accordance with the features which have already been described with respect to the first primary stage piston and the first secondary stage piston, also the second primary stage piston comprises a second primary outlet in a second primary piston face and a second primary check valve for the second primary outlet for providing access to the second secondary stage cylinder formed in the second primary stage piston. Moreover, it is preferred that the second secondary stage piston comprises a second secondary outlet in a second secondary piston face and a second secondary check valve for the second secondary outlet for discharging fluid to the pump outlet. For further details reference is made to above described features of the first primary stage piston and the first secondary stage piston.

According to a particularly preferred embodiment, the first secondary stage piston is attached to the second primary stage piston, and the second secondary stage piston is attached to the first primary stage piston. Thus, the pistons, which are preferably driven by the same eccentric, are attached to each other. Moreover, it is preferred that these pistons are integrally formed, in particular as a one-piece construction. This again may reduce the parts for the piston type pump and in addition can lead to a smaller design and reduced costs.

For assembling the piston type pump according to such an embodiment, preferably the first primary stage piston comprises an assembly opening in a first primary stage piston wall for allowing assembly of the first secondary stage piston into the first secondary stage cylinder. This is in particular preferred when the first secondary stage piston is attached to the second primary stage piston. The assembly opening preferably is also used for a first piston rod of the first secondary stage piston, which needs to be guided out of the first primary stage piston and in engagement with the second eccentric.

Moreover, it is preferred that the first primary stage piston comprises a first piston lid attached to the first primary stage piston and forming the first primary piston face. The separate piston lid, which forms a separate piston crown, allows that the first piston lid is removed and access granted to the first secondary stage cylinder. This again might be beneficial for assembly reasons, but also for reasons of manufacturing the first secondary stage cylinder and also the first primary outlet including the first primary check valve. The same arrangement might be provided for the second primary stage piston. In so far also the second primary stage piston may comprise a second piston lid attached to the second primary stage piston and forming the second primary piston face. In other embodiments a one-piece construction piston may be preferred.

In general it can be provided that the first primary stage piston and the second primary stage piston, as well as the first secondary stage piston and the second secondary stage piston are identically formed. This again reduces parts and can lower the cost.

The design of the first primary stage piston, the second primary stage piston, the first secondary stage piston, and the second secondary stage piston, which move in opposing directions may lead to lower losses and a lower noise generation. In particular a volume in a crankcase of the pump, i.e. the volume enclosed between the pump housing and the first and second secondary pistons will substantially not change, as the first and second secondary pistons move in accordance with each other. The first and the second primary pistons also move in opposing directions, thereby cancelling and/or minimizing a volume change effect what lead to lower losses and a lower noise generation. In particular the influence of the first and second primary pistons on the volume change in the crank case portion can be neglected as it is very small and in particular similar for the first and second primary stage pistons. This again may lead to additionally lower losses and lower noise generation.

According to a second aspect of the invention, a vehicle, in particular a passenger car, is provided that includes a piston type pump according to any of the aforementioned preferred embodiments of a piston type pump according to the first aspect of the invention.

It shall, however, also be understood that the pumps according to the present invention may also be used in applications other than vehicles, and in particular other than braking systems. Other uses of pumps for generating a vacuum on a vehicle can include engine mounts, compressor waste-gate and bypass valves actuation. This type of pump could also feasibly be used to evacuate a housing for a KERS (Kinetic Energy Recovery System) for example.

A piston type pump 1 according to the present disclosure is suitable to be mounted within a vehicle 100 (see FIG. 7) and used as a vacuum pump to provide vacuum for a braking system or any other consumer in this vehicle. The piston type pump 1 in particular is suitable to be driven by an electric motor which for simplicity is not shown in the drawings.

The following embodiment shows the piston type pump 1 prepared to be used as a vacuum pump and to induce a vacuum at a pump inlet 4. However, the same construction may also be used as a compressor.

In more detail the piston type pump 1 comprises a pump housing 2 which in the embodiment shown in FIG. 1 substantially is cylindrical. The pump housing 2 has a pump inlet 4 (see FIG. 6) which can be connected to a consumer. Moreover, the pump housing comprises a pump outlet 6 (see FIG. 6) which opens into the environment. The pump outlet 6 is formed as a simple opening in the pump housing 2. Fluid, in particular air, which is drawn away from the pump inlet 4, is not used and only discharged to the environment instead of being provided to any consumer, when the piston type pump 1 is used as a vacuum pump.

Within the pump housing 2 a piston arrangement 8 is provided, which will be described in more detail below. The piston arrangement 8 is connected to a drive shaft 10 which, when driven, sets the piston arrangement 8 into movement for inducing a vacuum at the pump inlet 4 in this embodiment. The drive shaft 10 is rotatable about a rotational axis A and may be connected to an electric motor.

The piston arrangement 8 according to the embodiment shown in FIG. 1 comprises a first primary stage piston 12 which is slidably seated in a first primary stage cylinder 14 formed in the pump housing 2. The first primary stage piston 12 in FIG. 1 is shown in its first end position, which is the position furthest away from the rotational axis A, however might travel within the first primary stage cylinder 14 to the left-hand side direction with respect to FIG. 1, thus closer to the rotational axis A.

The piston type pump 1 according to the shown embodiment is formed as a twin type two-stage piston pump and therefore also comprises a first secondary stage piston 16, which is provided within a first secondary stage cylinder 18, which is formed within the first primary stage piston 12. The first primary stage piston 12, therefore, is formed in a hollow manner, to form the first secondary stage cylinder 18. The first primary stage piston 12 comprises a first primary stage piston wall 13 which defines the first secondary stage cylinder 18. The first secondary stage cylinder 18 in particular is formed by an inner circumferential surface of the first primary stage piston wall 13 within the first primary stage piston 12.

For movement of the first primary stage piston and the first primary stage piston 12 and the first secondary stage piston 16, the first primary stage piston 12 is driven by a first eccentric 20 of the drive shaft 10 and the first secondary stage piston is driven by a second eccentric 22 of the drive shaft 10. Both, the first and the second eccentric 20, 22 are integrally formed with the shaft 10. The first eccentric 20 comprises a first eccentricity e1 and the second eccentric 22 comprises a second eccentricity e2. The first and the second eccentricities are measured with respect to the rotational axis A and in this embodiment comprise the same value. Thus, the first and second eccentricities e1, e2 are identically formed. Moreover, the first and second eccentrics 20, 21 are phase-shifted by 180°. Since the first primary stage piston 12 is in its right-hand maximum position, the first secondary stage piston 16 is in its left-hand extreme position due to the 180° phase shift of the first and the second eccentrics.

In a similar fashion the piston arrangement 8 according to this embodiment also comprises a second primary stage piston 40, which is slidably seated in a second primary stage cylinder 42, which again is formed inside the pump housing 2. The complete interior 3 of the pump housing 2 can be formed as a cylindrical hollow portion to form both, the first primary stage cylinder 14 and the second primary stage cylinder 42.

Also a second secondary stage cylinder 44 is provided which is slidably seated in a second secondary stage cylinder 46 formed within the second primary stage piston 40. Again the second primary stage piston 40 comprises a second primary stage piston wall 41 which defines the second secondary stage cylinder 46 by its inner circumferential surface restricting a second hollow space 47.

For driving the second primary stage piston 40 and the second secondary stage piston 44, the second primary stage piston 40 is connected to the second eccentric 22 and the second secondary stage piston 44 is connected to the first eccentric 20. Thus, the first eccentric 20 drives the first primary stage piston 12 as well as the second secondary stage piston 44 and in turn the second eccentric 22 drives the first secondary stage piston 16 and the second primary stage piston 40. Therefore, the movement of the pistons is identical, however, phase-shifted by 180°.

Moreover, in FIG. 1 it can be seen that the first primary stage cylinder 14 comprises a first central axis B1 and the second primary stage cylinder 42 comprises a second central axis B2, which are coaxial. Thus, the first and the second central axes B1, B2 form a single axis on which the first primary stage piston 12 and the second primary stage piston 40 move. When the first secondary stage cylinder 18 and the second secondary stage cylinder 46 are formed concentrically within the respective first primary stage piston 12 and the second primary stage piston 40, also the first secondary stage piston 16 and the second secondary stage piston 44 move coaxially with the first and second central axes B1, B2. Thus, the overall design of the piston type pump 1 is a boxer type piston type pump in which the single pistons move in opposing directions. This may lead to a well-balanced design.

The first secondary stage piston 16 comprises a first piston rod 54 which extends through a first assembly opening 60 in the first primary stage piston wall 13. The portion of the hollow space 19 which is on the opposite side of the piston rod 54 with respect to the first secondary piston face 30 can be named the first secondary stage working chamber. In the same manner the second secondary stage piston 44 comprises a second piston rod 56 which extends through a second assembly opening 58 formed in the second primary stage piston wall 41 of the second primary stage piston 40.

Figure 2:
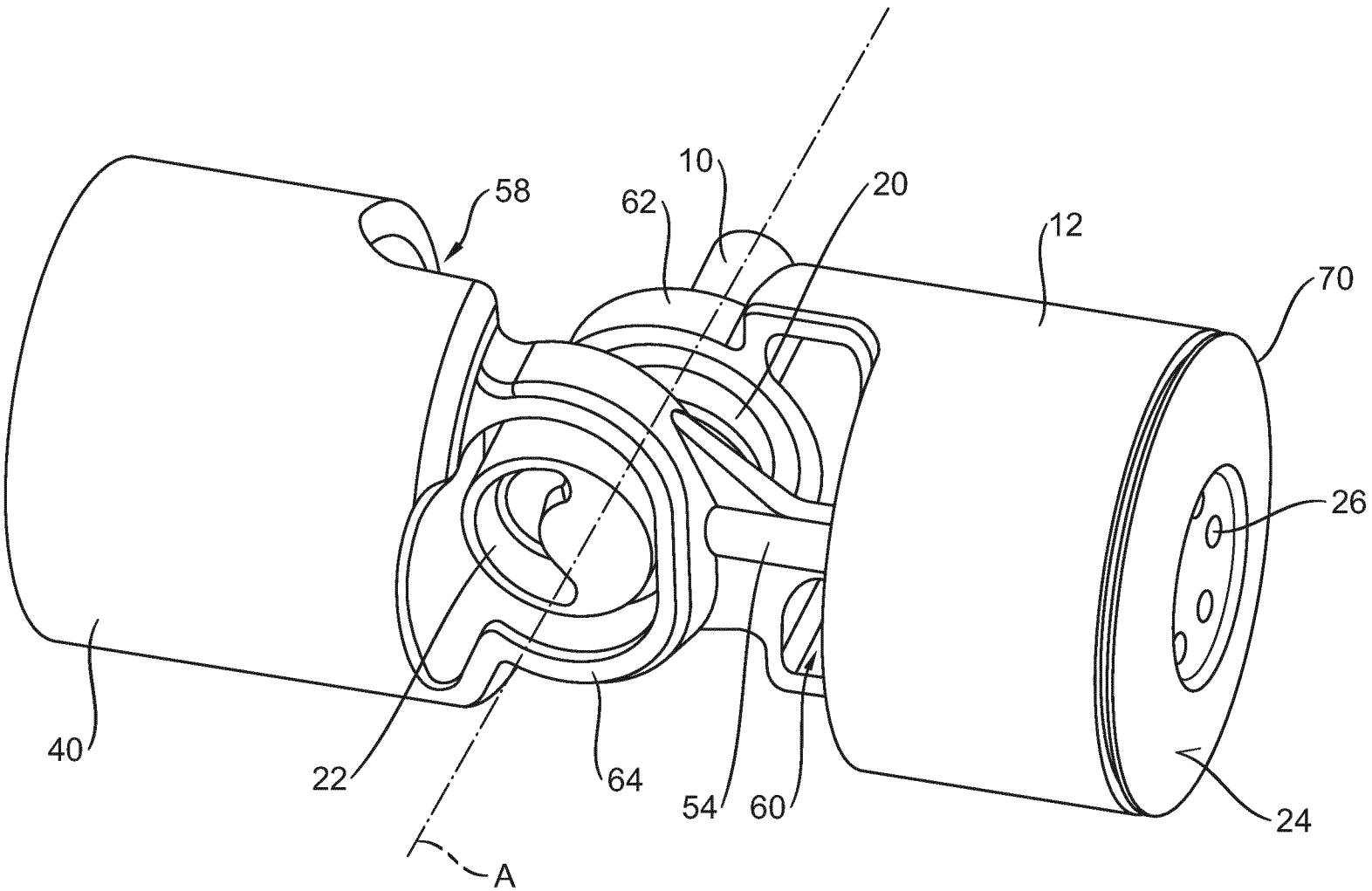
FIG. 2 shows a simplified perspective view of the piston arrangement with a drive shaft.

The second piston rod 56 is attached to a first sliding block guide 62 seated on the first eccentric 20. In turn, the first piston rod 54 is attached to a second sliding block guide 64, seated on the second eccentric 22 (see FIG. 2). The sliding block guides 62, 64 allow movement of the first and second eccentric 20, 22 such that the pistons can be driven.

According to this embodiment, the first and second sliding block guides 62, 64 are integrally formed with the respective pistons. In this instance, the first secondary stage piston 16, the first piston rod 54, the second sliding block guide 64 and the second primary stage piston 40 are integrally formed in a one-piece construction. In the same manner the second secondary stage piston 44, the second piston rod 56, the first sliding block guide 62 and the first primary stage piston 12 are integrally formed in a one-piece construction. The first assembly opening 60 and the second assembly opening 58 have a size such that the first and second secondary stage pistons 16, 44 may respectively be introduced through the first and second assembly openings 60, 58 to their respective first and second secondary stage cylinders 18, 46. This is necessary in the one-piece construction to assemble the piston assembly 8 together.

Now beginning with FIG. 6, the flow of fluid will be described in more detail.

The pump inlet 4 (see FIG. 6) is here only shown as a single opening which is in fluid connection with a first conduit 74 formed in the pump housing 2. The conduit 74 is surrounded by a protrusion 75 of the pump housing 2, which can be seen in FIG. 1 also. This first conduit 74 substantially extends in a parallel way to the first and second central axes B1, B2. The first conduit 74 on the one hand leads to a second conduit 76 formed in a first housing lid 78 which closes the pump housing 2 and also closes the first primary stage cylinder 14. This second conduit 76 terminates in a first inlet chamber 80 which is closed to the environment by means of a first chamber lid 82. The first inlet chamber 80 comprises a first inlet check valve 84 which allows fluid to flow through the first conduit 74, the second conduit 76, the inlet chamber 80 into the first primary stage cylinder 14, but not vice versa. This is indicated by the arrows in FIG. 6. The first inlet check valve 84 can be formed as a leaf valve and comprises a leaf 86 which is flexible and might be formed out of any flexible material, such as thin metal, elastomer or the like.

A similar arrangement is provided on the other end of the pump housing 2 (see FIG. 1). Even though FIG. 1 is not as detailed as FIG. 6, it shall be understood that the same arrangement is provided. In particular, the pump housing 2 comprises a second housing lid 88 comprising a second inlet chamber 90 with a second inlet check valve 92 and a respective second leaf of the second inlet check valve 92. A third conduit 96 is provided in the second housing lid 88, however, not shown in cut view in FIG. 1, but connected to the first conduit 74 in a similar manner as it has been described with respect to the second conduit 76. Again the second inlet check valve 52 allows fluid to enter the second stage cylinder 46 through the first conduit 74, the third conduit 96, the second inlet chamber 90 and the second inlet check valve 92. The first housing lid 78 and the second housing lid 88 may be formed identical to each other or in a mirrored fashion. In any case manufacturing of the piston type pump 1 is simplified.

When now the drive shaft 10 begins to rotate due to operation of an electric motor attached to the drive shaft 10, the first and second primary stage pistons 12, 40 (see FIG. 1) will move along the respective first and second central axes B1, B2 toward the rotational axis A. Thus, the working chamber, which is formed between the piston housing 2, the respective housing lids 78, 88 and the respective first and second primary stage pistons 12, 40 will be enlarged and therefore fluid will be drawn through the pump inlet 4, the first conduit 74, the second and third conduits 76, 96, the first and the second inlet chambers 80, 90 and the first and second inlet check valves 84, 92. Due to the movement of the first and second primary stage pistons 12, 40 the primary stage vacuum is induced at the pump inlet 4.

When now the drive shaft 10 continues to rotate, the first and second primary stage pistons 12, 40 will again be pushed outwardly, i.e. away from the rotational axis A. The respective first and second working chambers will become smaller and residual fluid, which is in these working chambers, will be compressed. The first and second inlet check valves 84, 92 prevent this fluid from flowing toward the pump inlet 4 again. However, this fluid needs to exit the piston type pump 1. To achieve this, the first primary piston face 24 is provided with a first primary outlet 26 which in turn is provided with a first primary check valve 28. Thus, the fluid contained in the first working chamber can flow through the first primary outlet 26 and the first primary check valve 28 into the first secondary stage cylinder 18.

In the same manner also a second primary piston face 48 of the second primary stage piston 40 is provided with a second primary outlet 50 which in turn is provided with a second primary check valve 52. Thus, fluid contained in the second working chamber may flow through the second primary outlet 50 and the second primary check valve 52 into the second secondary stage cylinder 46 upon movement of the second primary piston 40 away from the rotational axis A.

Both, the first and second primary check valves 28, 52 again might be formed as leaf valves and comprise respective first and second primary check valve leaves 96, 98 which can be identical to leaves 86, 94.

For a more easy manufacturing and assembly, the first primary stage piston face 24 is defined by a first primary stage piston lid 70 attached to the first primary piston wall 13. This first primary stage piston lid 70 carries the first primary check valve 28. Also the second primary stage piston face 48 is defined by a second primary stage piston lid 72 attached to the second primary piston wall 41. This second primary stage piston lid 72 carries the second primary check valve 52.

When the first and second primary stage pistons 12, 40 are in the central position, thus proximal to the rotational axis A, the first and second secondary stage pistons 16, 44 are at the outermost position, thus most distal to the rotational axis A, due to their connection to the first and second eccentrics 20, 21. In this position the first and second secondary stage pistons 16, 44 are proximal to the first and second primary check valves 28, 52 and the respective working chamber is small. Upon rotation of the central drive shaft 10 and movement of the first and second primary stage pistons 12, 40 outwardly, the first and second secondary stage pistons 16, 44 are drawn inwardly toward the rotational axis A, therefore enlarging the respective first and second secondary stage working chambers. A vacuum is induced and additional fluid may flow from the pump inlet 4 through the first and second inlet check valves 84, 92, the first and second primary check valves 28, 52 into the first and second secondary stage working chambers.

On the other hand, when the drive shaft 10 rotates further, the first and second secondary stage pistons 16, 44 are pushed outwardly again, thus decreasing the respective first and second secondary stage working chambers. The fluid, contained in these first and second secondary stage working chambers needs to exit the piston type pump 1.

Figure 3:
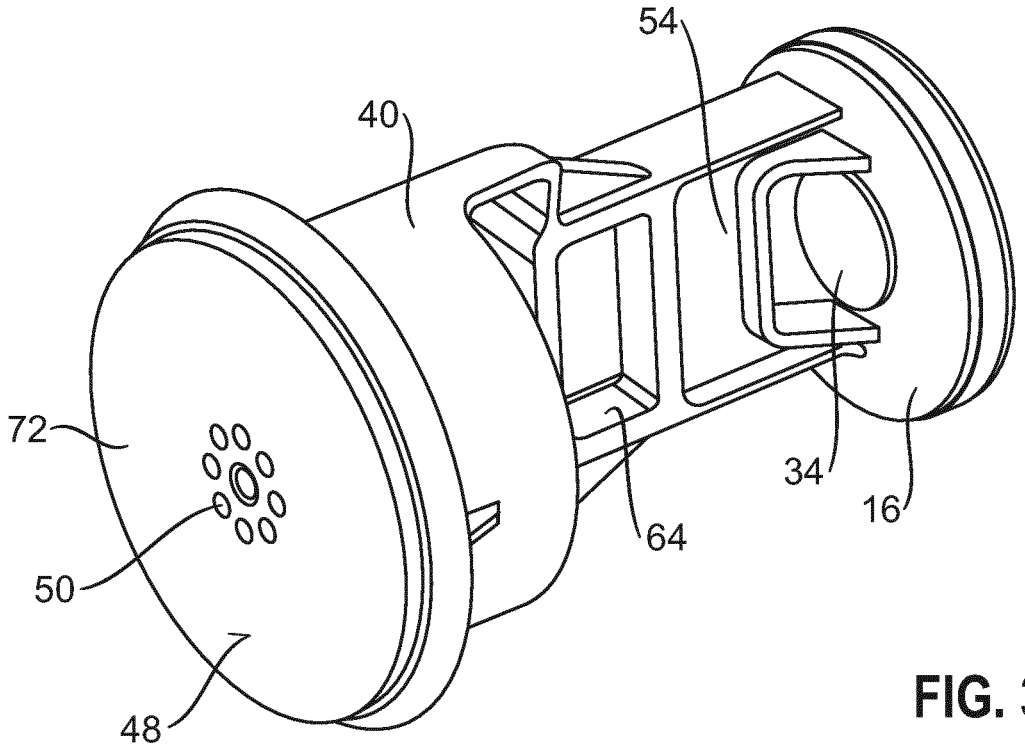
FIG. 3 shows a perspective view of a second primary stage piston and a first secondary stage piston attached together.
Figure 4:
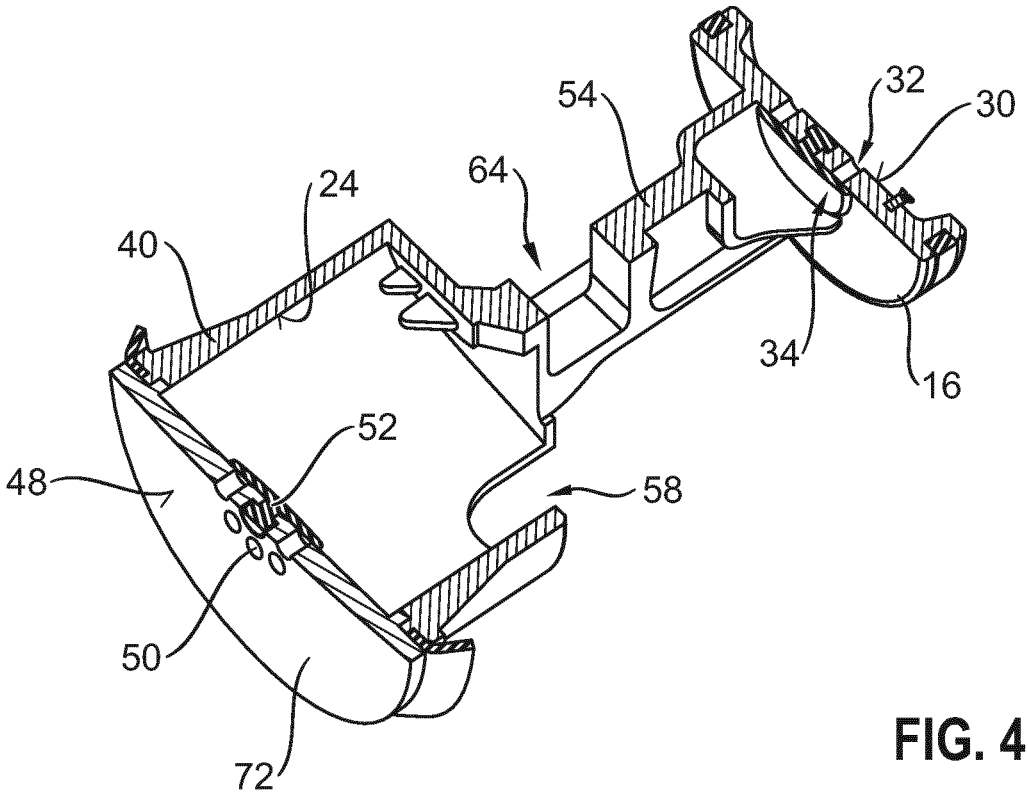
FIG. 4 shows the arrangement of FIG. 3 in a cut view.
Figure 5:
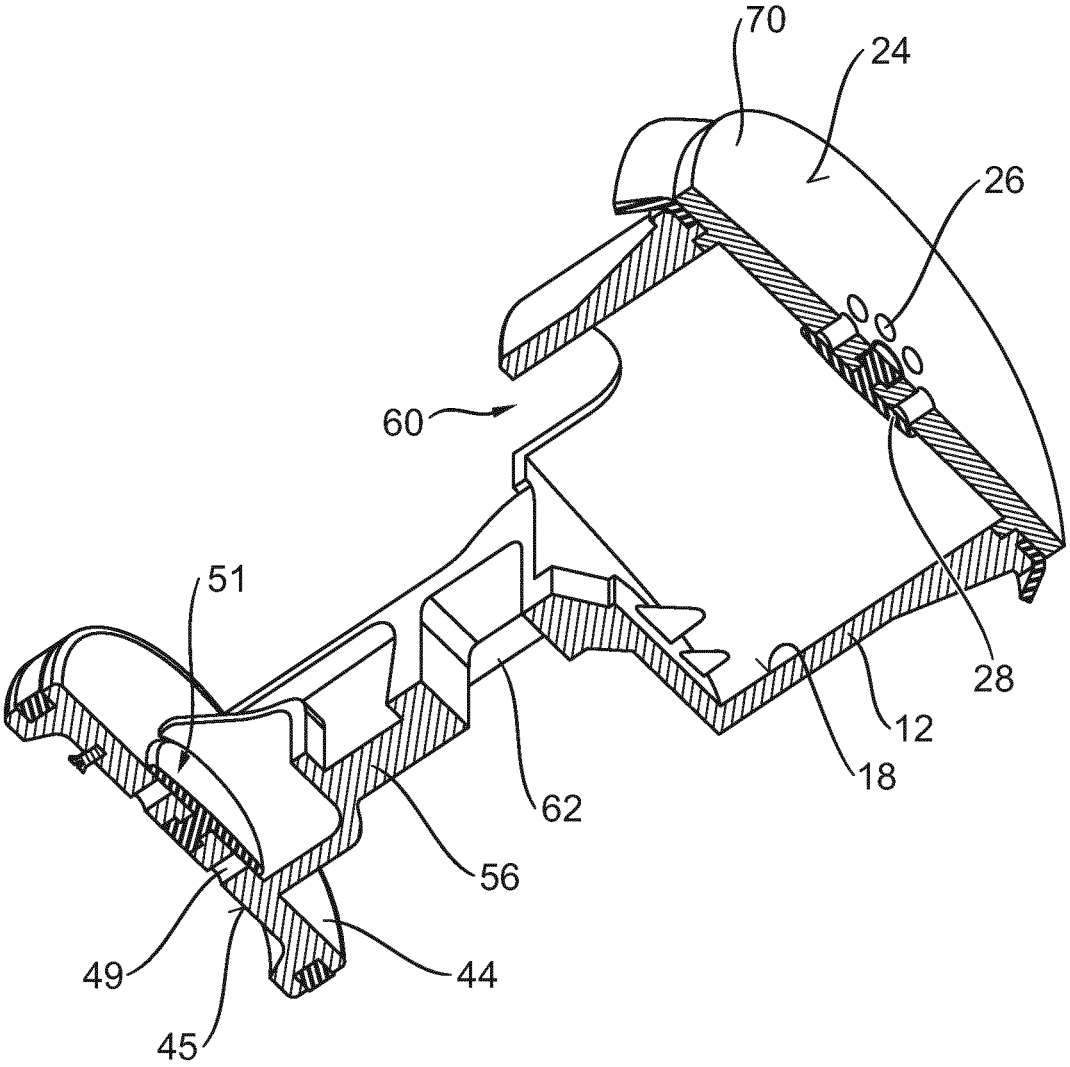
FIG. 5 shows a cut view of a first primary stage piston and a second secondary stage piston attached together.
Figure 6:
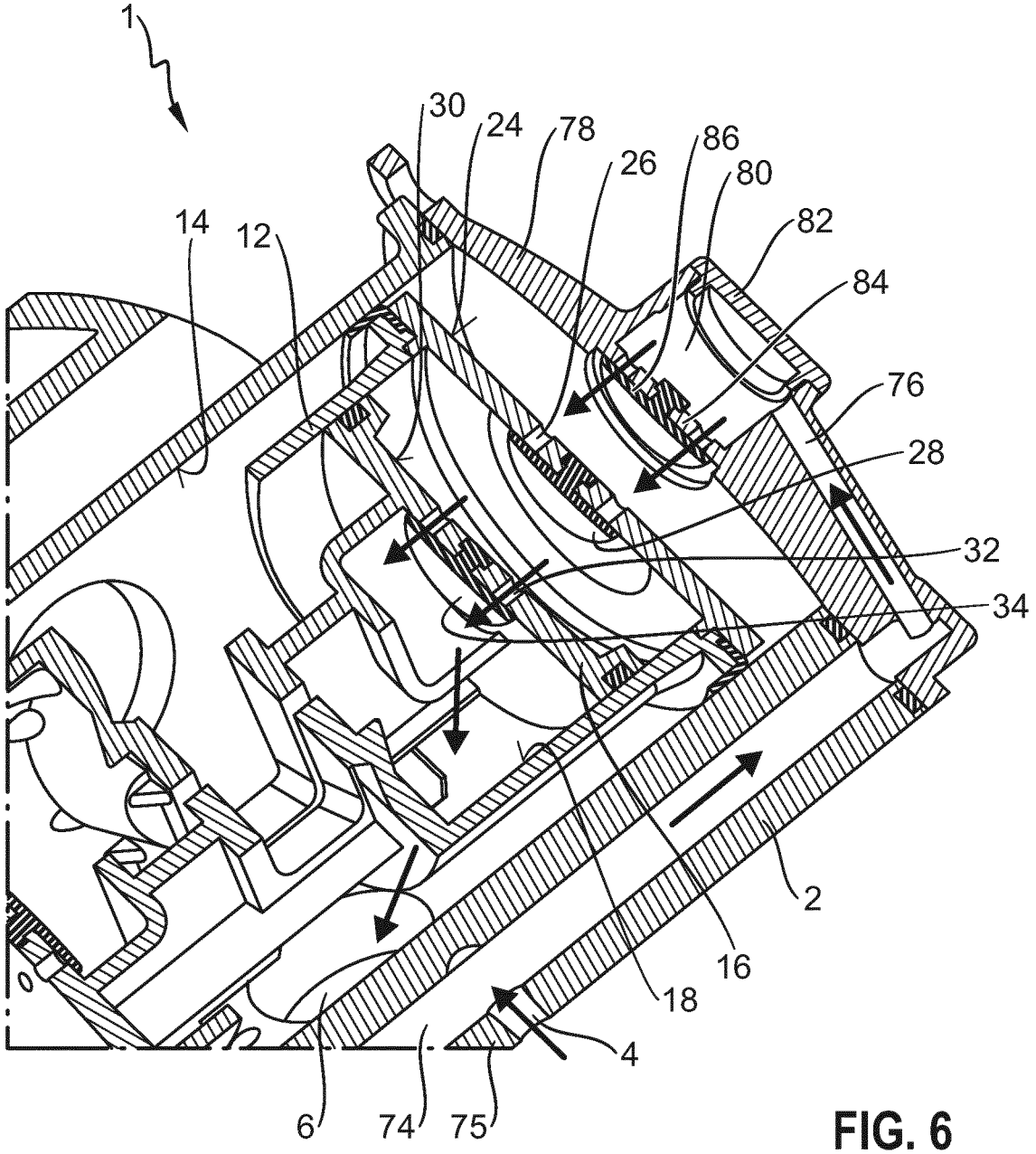
FIG. 6 shows a more detailed cut view of FIG. 1 in the area of the first primary stage piston.

To achieve this, the first secondary piston face 30 is provided with a first secondary outlet 32, which in turn is provided with a first secondary check valve 34 (see FIGS. 3, 4 and 6). As shown in FIG. 6, fluid can pass through this first secondary check valve 34 and out of the pump outlet 6.

In the same manner, also the second secondary stage cylinder 46 is provided with a second secondary outlet 49 in a second secondary piston face 45 and a second secondary check valve 51. Again, fluid may pass through this second secondary check valve 51 and out of the pump outlet 6.

Afterwards, the drive shaft 10 rotates further and again moves the first and second secondary stage pistons 16, 44 toward the rotational axis A.

It shall be understood that dependent on how the first, second and third conduits 74, 76, 96 are arranged, also the, for example, first secondary outlet 32 may be guided into the second primary stage working chamber, thus into the second primary stage cylinder 42 and the vacuum may be further decreased. In such an arrangement the piston type pump 1 would be a four stage vacuum pump instead of a two stage twin type vacuum pump as shown in the embodiments in the attached figures.

Figure 7:
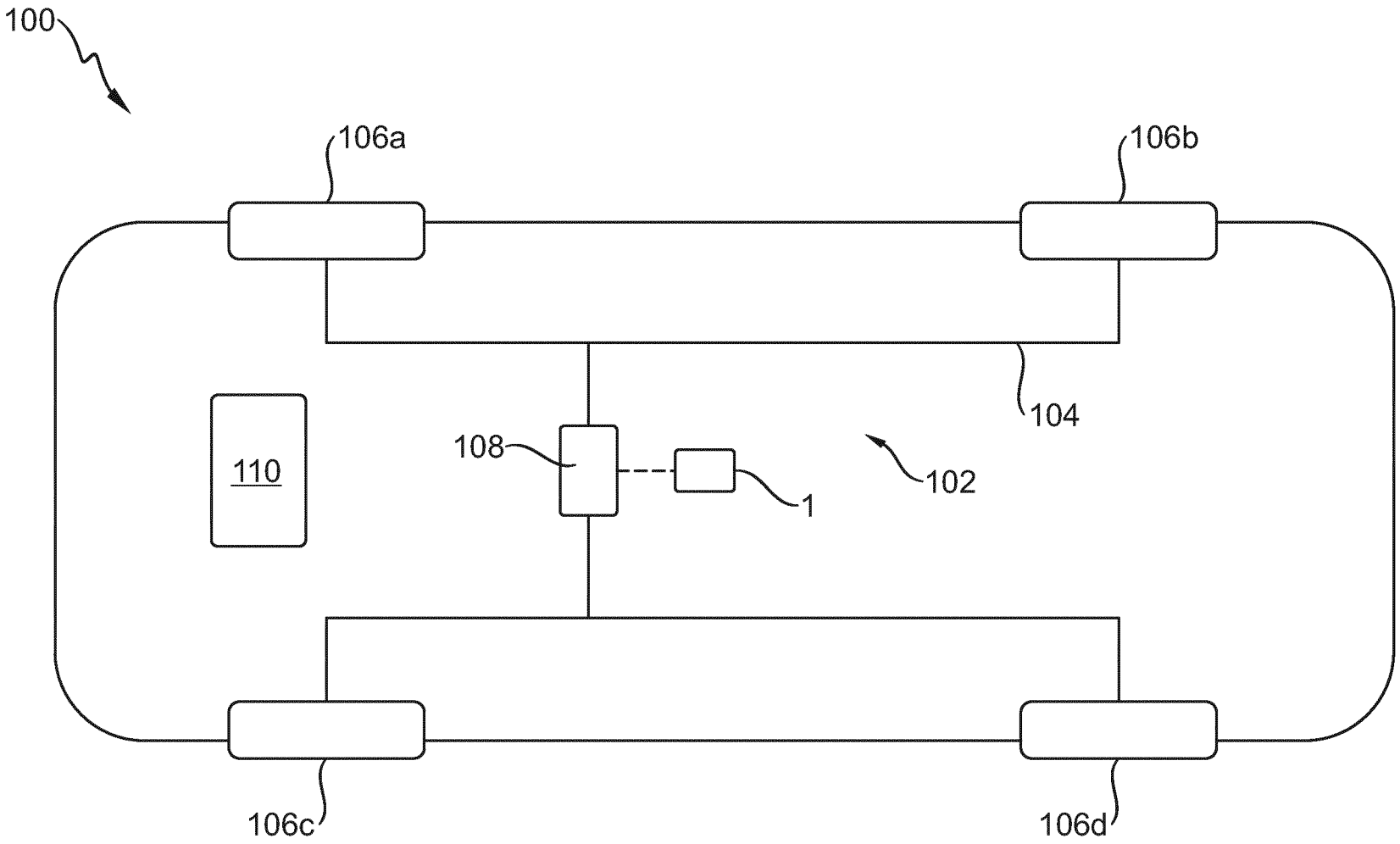
FIG. 7 shows a schematic view of a vehicle.

FIG. 7 now depicts a schematic drawing of a vehicle 100. Vehicle 100 preferably is formed as a passenger car, or a light truck and comprises a pneumatic braking system 102. The braking system 102 is shown by lines 104 leading to wheels 106*a*, 106*b*, 106*c*, 106*d* for providing the wheels 106*a*, 106*b*, 106*c*, 106*d* with the respective braking pressure. Lines 104 are connected to a central module 108. The vehicle 100 moreover comprises an engine 110 and a piston type pump 1, which is herein used as a vacuum pump 1. Piston type pump 1 provides the braking system 102 with vacuum, which e.g. could be used by a brake booster of the braking system 102, which could be implemented in the central module 108.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A piston type pump, comprising:
a pump housing including:
at least one pump inlet,
at least one pump outlet, and
a piston arrangement connected to a drive shaft configured to, when driven, set the piston arrangement into movement,
wherein the piston arrangement comprises:
a first primary stage piston, the first primary stage piston being slidably seated in a first primary stage cylinder formed in the pump housing,
a first secondary stage piston,
a second primary stage piston, whereas the second primary stage piston is slidably seated in a second primary stage cylinder formed in the pump housing, and
a second secondary stage piston, the second secondary stage piston being slidably seated in a second secondary stage cylinder formed in the second primary stage piston,
wherein the first secondary stage piston is slidably seated in a first secondary stage cylinder formed in the first primary stage piston, and
wherein the first secondary stage piston is attached to the second primary stage piston and the second secondary stage piston is attached to the first primary stage piston.

2. The piston type pump according to claim 1, wherein the first primary stage piston and the first secondary stage cylinder are integrally formed.

3. The piston type pump according to claim 1, wherein the drive shaft comprises a first eccentric and a second eccentric, the first eccentric and the second eccentric being phase shifted by 180°, wherein the first primary stage piston is driven by the first eccentric and the first secondary stage piston is driven by the second eccentric.

4. The piston type pump according to claim 3, wherein the second primary stage piston is driven by the second eccentric and the second secondary stage piston is driven by the first eccentric.

5. The piston type pump according to claim 3, wherein the first eccentric comprises a first eccentricity with respect to a rotational axis of the drive shaft, and the second eccentric comprises a second eccentricity with respect to the rotational axis, wherein the first eccentricity is identical to the second eccentricity.

6. The piston type pump according to claim 5, wherein the first and second eccentrics are integrally formed with the drive shaft.

7. The piston type pump according to claim 1, wherein the first primary stage piston comprises a first primary outlet in a first primary piston face and a first primary check valve for the first primary outlet configured to provide fluid access to the first secondary stage cylinder formed in the first primary stage piston.

8. The piston type pump according to claim 1, wherein the second primary stage piston and the second secondary stage cylinder are integrally formed.

9. The piston type pump according to claim 1, wherein the first primary stage piston comprises a first central axis and the second primary stage piston comprises a second central axis arranged coaxially with the first central axis.

10. The piston type pump according to claim 1, wherein the second primary stage piston comprises a second primary outlet in a second primary piston face and a second primary check valve for the second primary outlet configured to provide fluid access to the second secondary stage cylinder formed in the second primary stage piston.

11. The piston type pump according to claim 1, wherein the first secondary stage piston and the second primary stage piston are integrally formed; and
wherein the second secondary stage piston and the first primary stage piston are integrally formed.

12. The piston type pump according to claim 1, wherein the first primary stage piston comprises an assembly opening in a first primary stage piston wall configured to allow assembly of the first secondary stage piston into the first secondary stage cylinder.

13. The piston type pump according to claim 1, wherein the first primary stage piston comprises a first piston lid attached to the first primary stage piston and forming the first primary piston face.

14. The piston type pump according to claim 1, wherein the piston type pump is a vacuum pump in a vehicle.

15. A vehicle comprising a piston type pump according to claim 1.

16. A piston type pump, comprising:
a pump housing including:
at least one pump inlet,
at least one pump outlet, and
a piston arrangement connected to a drive shaft configured to, when driven, set the piston arrangement into movement,
wherein the piston arrangement comprises:
a first primary stage piston, the first primary stage piston being slidably seated in a first primary stage cylinder formed in the pump housing, and
a first secondary stage piston, wherein the first secondary stage piston is slidably seated in a first secondary stage cylinder formed in the first primary stage piston, and the first secondary stage piston comprises a first secondary outlet in a first secondary piston face and a first secondary check valve for the first secondary outlet configured to discharge fluid to the pump outlet.

17. A piston type pump, comprising:
a pump housing including:
at least one pump inlet,
at least one pump outlet, and
a piston arrangement connected to a drive shaft configured to, when driven, set the piston arrangement into movement,
wherein the piston arrangement comprises:
a first primary stage piston, the first primary stage piston being slidably seated in a first primary stage cylinder formed in the pump housing;
a first secondary stage piston;
a second primary stage piston, whereas the second primary stage piston is slidably seated in a second primary stage cylinder formed in the pump housing; and
a second secondary stage piston, the second secondary stage piston being slidably seated in a second secondary stage cylinder formed in the second primary stage piston, the second secondary stage piston comprising a second secondary outlet in a second secondary piston face and a second secondary check valve for the second secondary outlet for discharging fluid to the pump outlet,
and wherein the first secondary stage piston is slidably seated in a first secondary stage cylinder formed in the first primary stage piston.

* * * * *